US006762374B2

(12) United States Patent
Pedrinelli et al.

(10) Patent No.: US 6,762,374 B2
(45) Date of Patent: Jul. 13, 2004

(54) ISOLATABLE ELECTRICAL CONTACT DEVICE, ESPECIALLY FOR ELECTRICAL TERMINAL BLOCK

(75) Inventors: Pascal Pedrinelli, Anse (FR); Arsene Schmidt, St Cyr au Mont d'Or (FR)

(73) Assignee: ABB Entrelec, Villeurbanne (FR)

( * ) Notice: Subject to any disclaimer, the term of this patent is extended or adjusted under 35 U.S.C. 154(b) by 0 days.

(21) Appl. No.: 10/362,047

(22) PCT Filed: Sep. 12, 2001

(86) PCT No.: PCT/FR01/02834

§ 371 (c)(1),
(2), (4) Date: Jun. 2, 2003

(87) PCT Pub. No.: WO02/23675

PCT Pub. Date: Mar. 21, 2002

(65) Prior Publication Data

US 2004/0011630 A1 Jan. 22, 2004

(30) Foreign Application Priority Data

Sep. 12, 2000 (FR) ..... 00 11609

(51) Int. Cl.[7] ..... H01H 3/00
(52) U.S. Cl. ..... 200/16 R; 200/16 A; 200/318.2
(58) Field of Search ..... 200/16 R–16 C, 200/43.11–43.18, 520, 523–526, 530, 534, 318–318.2, 334

(56) References Cited

U.S. PATENT DOCUMENTS

| | | | | |
|---|---|---|---|---|
| 4,227,058 A | * | 10/1980 | Johnston et al. | 200/566 |
| 4,703,141 A | * | 10/1987 | Grunst | 200/318.2 |
| 5,593,022 A | * | 1/1997 | Schaeffer et al. | 200/308 |
| 6,444,932 B1 | * | 9/2002 | Resmalm | 200/334 |
| 6,483,058 B2 | * | 11/2002 | Ehrensberger | 200/302.2 |

FOREIGN PATENT DOCUMENTS

| | | | |
|---|---|---|---|
| DE | 16 64 980 U | 10/1953 | |
| FR | 1 583 306 A | 10/1969 | |
| FR | 2 293 082 A | 6/1976 | H01R/9/02 |

* cited by examiner

*Primary Examiner*—Michael A. Friedhofer
(74) *Attorney, Agent, or Firm*—Oliff & Berridge, PLC

(57) ABSTRACT

A device comprising two conductive spaced apart components (3, 4) and a blade (5) in the form of a conductive segment mobile between a position closing the circuit wherein it is in contact with the two conductive components and a position opening the circuit, wherein it is spaced apart from said components. The blade is mounted locked in translation on a rod (7) axially mobile in the box between a retracted position in the box wherein the blade (5) is in contact with the conductive components and a projecting position wherein the blade is spaced apart from the conductive components, means being provided to maintain the rod stable in those two positions.

17 Claims, 7 Drawing Sheets

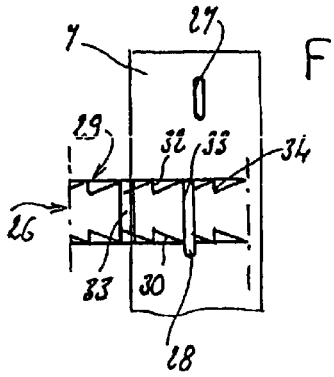
FIG 14
FIG 15
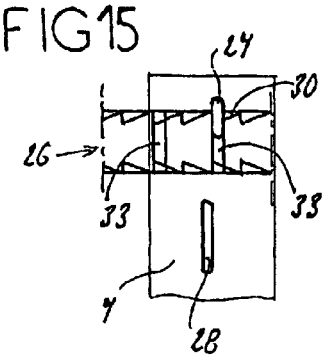
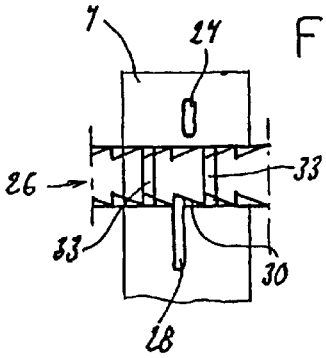
FIG 16
FIG 17
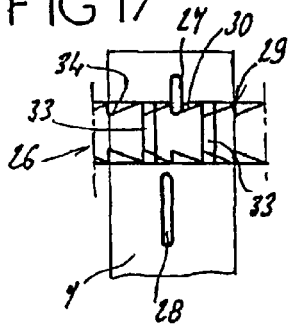
FIG 18
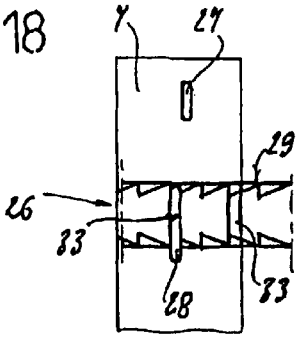

ISOLATABLE ELECTRICAL CONTACT DEVICE, ESPECIALLY FOR ELECTRICAL TERMINAL BLOCK

It is known to produce isolatable electrical contact devices having two conducting components located at some distance from each other, each one of which can be connected to a conducting element, it being possible to establish an electrical connection between these two conducting components via a blade in the form of a conducting strip which can be moved between a closed position of the circuit in which it is in contact with the two conducting components and an open position of the circuit in which it is separated from these components.

Generally, the blade is mounted so that it can pivot between its closed position and its open position.

Isolatable electrical contact devices are often used in difficult environments, which are difficult especially in terms of vibration, dust or corrosive atmosphere.

The aim of the invention is to provide an isolatable contact which is highly reliable, including in difficult environments.

To achieve these objectives, the invention relates to an electrical terminal block comprising, inside an insulating casing:

- two conducting components (3, 4) located at some distance from each other, each of which can be connected to a conducting element, for example via a wire;
- a blade (5) in the form of a conducting strip which can be moved between a closed position of the circuit in which it is in contact with the two conducting components and an open position of the circuit, in which it is separated from these components;
- a rod (7) translationally connected to the blade (5) and which can be moved axially in the casing (2) between an "inserted" position in the casing in which the blade (5) is in the closed position of the circuit and a "withdrawn" position in which the blade (5) is in the open position of the circuit;
- means for holding the rod in a stable manner in one or the other of the two withdrawn or inserted positions.

According to the invention, the terminal block is characterized in that:

- the means holding the rod (7) in the withdrawn position comprise a spiral spring (11) inserted between the casing and the rod (7); and
- the means holding the rod in the inserted position are associated with the rod (7) itself.

In some applications, several contacts are juxtaposed and must be actuated in a coupled manner. In such a case, the rods associated with the various contacts are parallel and their free ends are connected by a bar-shaped element on which a drive rod acts, which drive rod, parallel to the rods of the various blocks, is equipped with means for holding the contacts in the closed position.

According to a first possibility, the means holding a rod in the closed position of the electrical contact comprise a finger extending perpendicularly from the rod and engaged in a groove made in the casing for guiding the rod, oriented parallel to the rod and comprising, at its end located closest to the contact, a 90° return.

To close the contact, it is appropriate to slide the rod in a direction in which it is inserted into the casing, then to make it rotate when the finger extending from the rod butts against the lower end of the groove. In order to ensure proper locking of the rod in the closed position of the contact, the return of the groove for guiding the finger itself comprises, at its end, a notch for locking the finger.

To open the contact, it is appropriate to release the finger from the locking notch in which it is engaged, then to make the rod pivot until the finger is located in the groove made parallel to the axis of the rod. The spring then returns the rod to the open position of the contact. To actuate the rod in rotation, it is possible to provide the end thereof with a slot allowing the blade of a screwdriver to be engaged.

According to a second possibility, the means holding a rod in the closed position of the electrical contact comprise a finger extending perpendicularly from the rod and engaged in an inclined groove made in the casing for guiding the rod and having a notch for locking the finger in the position in which the rod is most engaged in the casing.

Advantageously, the groove is continuous and the casing in which it is made comprises, on its periphery, several successive groove portions successively corresponding to the movement of the rod toward the closed position of the contact and toward the open position of the contact.

In this case, the translational movement of the rod is accompanied by a rotational movement thereof. Insofar as the groove extends continuously over the periphery of the bore of the casing in which it is made, it is possible to make the rod pass from a withdrawn position to an inserted position then from an inserted position to a withdrawn position while always rotating the rod in the same direction.

According to yet another possibility, the means holding a rod in the closed position of the electrical contact comprise a ring which, engaged around the rod and mounted so that it is free in rotation and blocked in translation in the insulating casing, has two sawtoothed edges, the various teeth being defined by an inclined portion followed by a portion parallel to the axis of the ring, all the inclined portions being inclined in the same direction, the ring having axial grooves opening out in its inner wall, made alternately with the recessed regions of the sawtoothed profile, while the rod has two radially protruding lugs which are offset axially by a value at least equal to the width of the ring, in order to be located on either side thereof, the two lugs being offset circumferentially by a value substantially equal to the length of a tooth, the lug located on the side of the free end of the rod serving, by pressing against the inclined faces of the teeth of the ring, to produce the rotational drive of the ring, in order successively to bring the other lug pressing in the recess of a tooth, with an axial position of the rod corresponding to the closure of the contact, and on the inside of a groove, with an axial position of the rod corresponding to the opening of the contact. Any pressure exerted on the rod causes the notched ring to pivot, and the rod to pass from the closed position of the contact to the open position of the contact and so on and so forth.

In the embodiments in which the rod pivots when passing from the closed position to the open position of the contact and vice versa, the blade is mounted so that it can rotate freely on the rod which is associated with it and which is guided in translation, with rotational locking, in the insulating casing.

In any case, the invention will be better understood with the help of the following description, with reference to the appended schematic drawing showing, by way of nonlimiting example, four embodiments of this isolatable electrical contact device.

FIGS. 14 to 18 are five schematic views illustrating the principle of actuating the rod bearing the blade for closing the contact;

Figure 1:
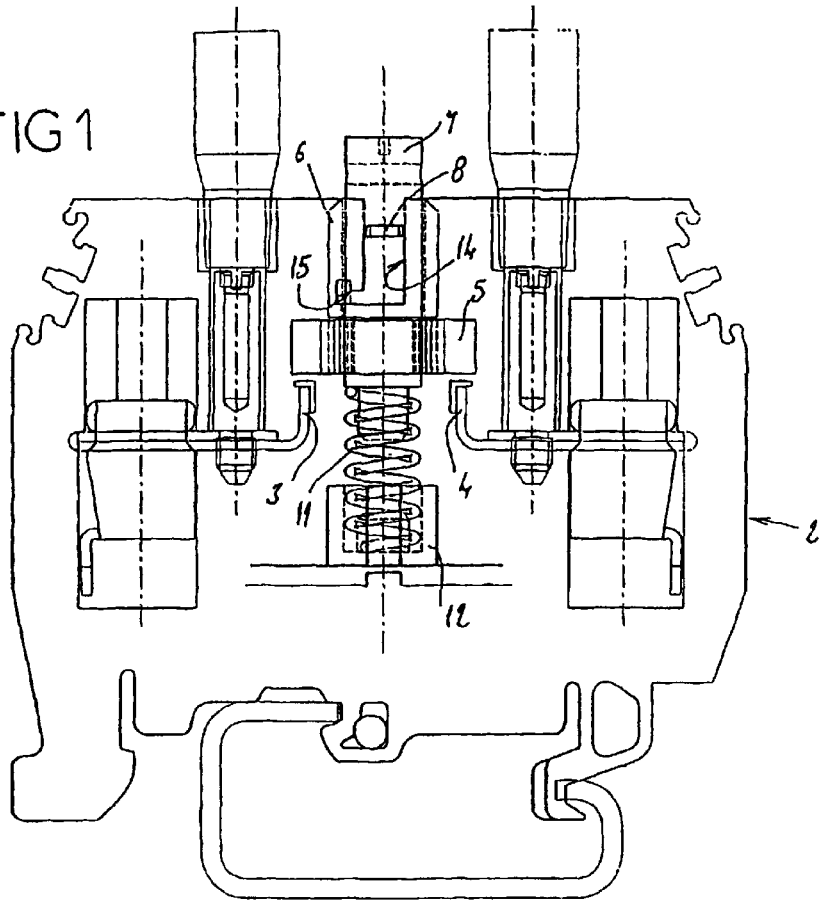
FIG. 1 is a side view of a first terminal block in the open position of the contact.
Figure 2:
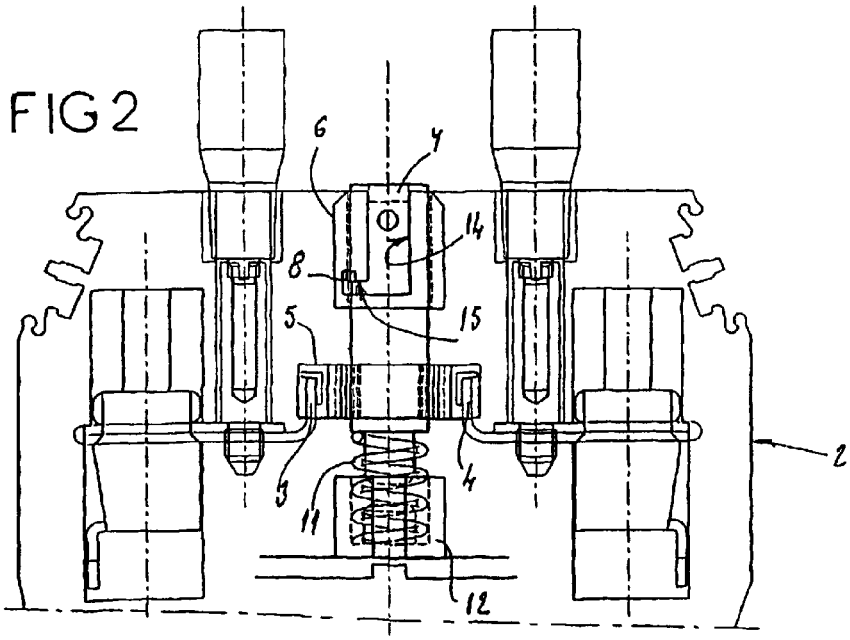
FIG. 2 is a view similar to FIG. 1 in the closed position of the contact.
Figure 3:
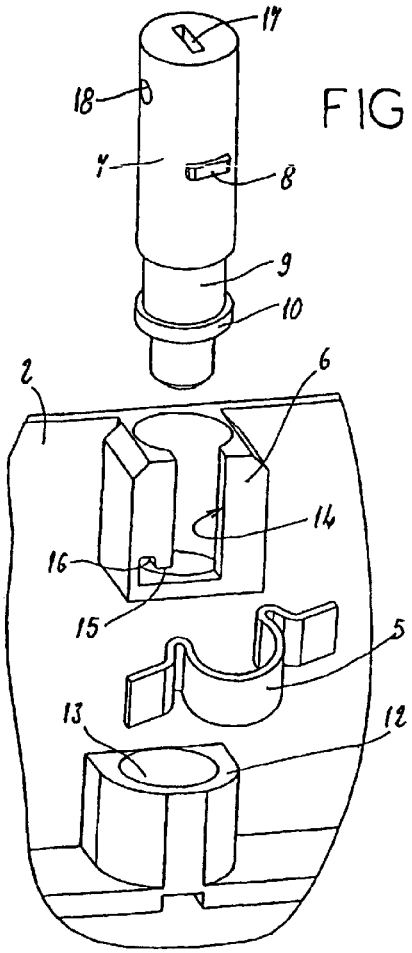
FIG. 3 is an exploded perspective view of the means for actuating the contact.
Figure 4:
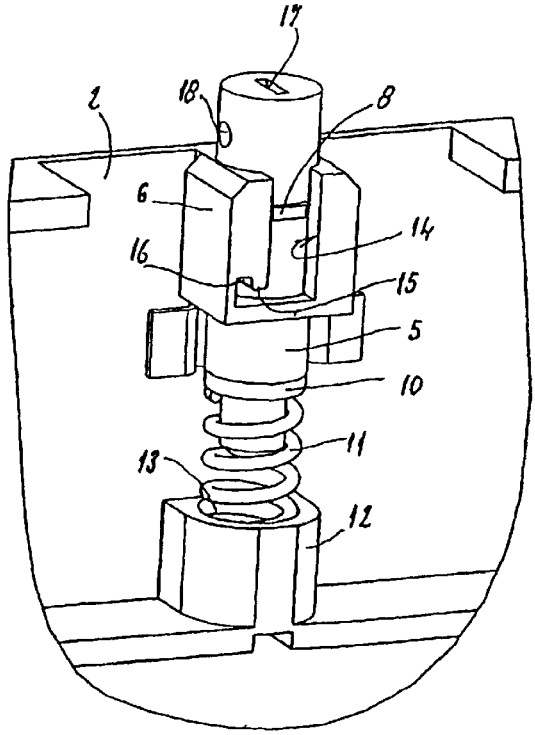
FIG. 4 is a perspective view of these same means in the assembled position.
Figure 5:
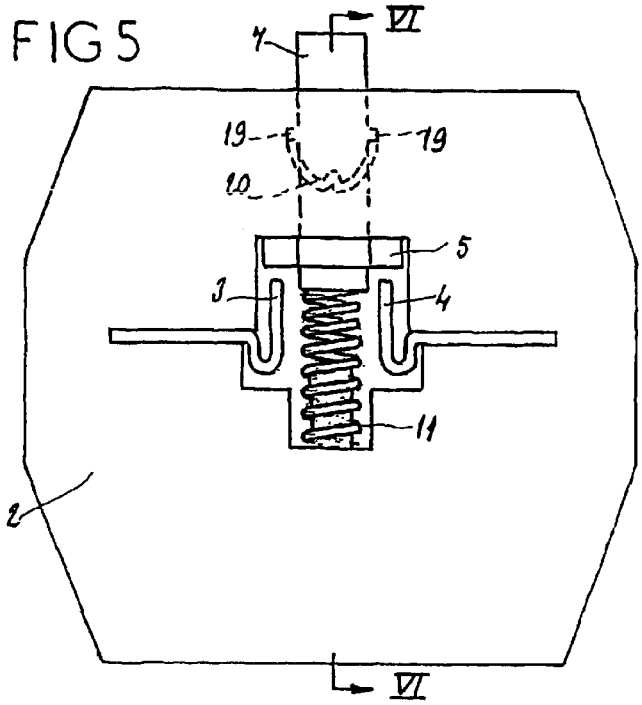
FIG. 5 is a very schematic side view of a second device in the open position of the contact.
Figure 6:
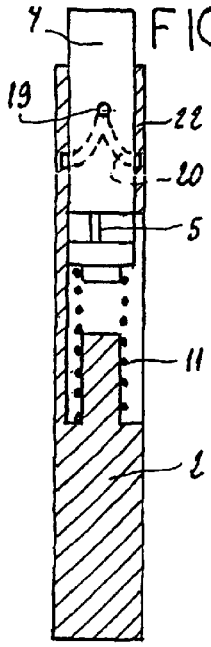
FIG. 6 is a sectional view thereof along line VI—VI of FIG. 5.

The device shown in FIGS. 1 to 4 comprises a terminal block 2 equipped with two conducting bars 3 and 4 between which an electrical connection must be made by means of a blade 5. Moreover, the bars 3 and 4 are electrically connected to electrical connection parts such as, according to the example illustrated, screw connection jaws. Of course, the bars 3 and 4 can be connected to other connection accessories, such as, for example but not exclusively self-stripping jaws or IDC tines for plugs.

An annular part 6 intended for guiding a cylindrical rod 7 is made in the insulating casing forming the terminal block. This cylindrical rod 7 comprises, in its upper part, a finger 8 which projects radially therefrom and, in its lower part, a recess 9 limited toward the bottom by a shoulder 10. The recess 9 serves for assembling the blade 5 which is in the form of a strip having an Ω-shaped profile, the central part of which is engaged on the recess 9, which makes it possible for the strip 5 to be locked on the rod 7 but to be able to pivot freely with respect to the latter. This rotational locking of the strip 5 is achieved by guides made in the casing of the terminal block, these guides not being shown in the drawing. A block 12 comprising a housing 13 which is open toward the top is made opposite and below the annular part 6. The lower end of the rod 7 is engaged in this housing 13 and a helical spring 11, which surrounds the rod, and presses, on the one hand, on the bottom of the housing 13 and, on the other hand, against the shoulder 10, is housed in this housing 13. An axial groove 14, in which the finger 8 is engaged, is made in the annular part 6. At its lower end, the groove 14 comprises a 90° return 15, which itself is terminated by an upwardly-turned recess 16 defining a locking notch. At its upper end, the rod 7 comprises a slot 17 making it possible to engage the blade of a screwdriver, and has a diametral through-hole 18.

In practice, when the finger 8 is in the position shown in FIGS. 1 to 4, that is to say engaged in the groove 14, the spring 11 is in the extended position, the rod 7 being pushed upward, the blade 5 is located above the conducting bars 3 and 4, without contact with the latter, and the end of the rod goes beyond the casing. It is then possible to identify immediately and visually that the contact is in the open position by noting that the upper end of the rod extends beyond the casing. It is also possible, in the open position of the contact, to lock the rod 7 in the high position by passing an element through the diametral hole 8, such as a link which can be provided with a tamperproof seal for safety reasons.

In order to close the contact, pressure should be applied to the rod 7 until the finger comes to the bottom of the groove 14, then the rod should be made to pivot, for example using the blade of a screwdriver, until the finger comes into abutment in the bottom of the return 15, thereby being locked behind the notch 16. The contact passes to the open position by a reverse maneuver.

FIGS. 5 to 9 show another embodiment of this device in which the same elements are denoted by the same references as above.

Figure 7:
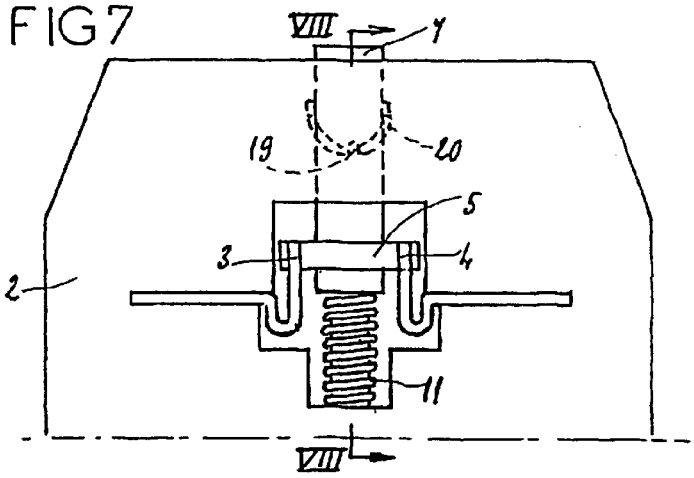
FIG. 7 is a view similar to FIG. 5 in the closed position of the contact.
Figure 8:
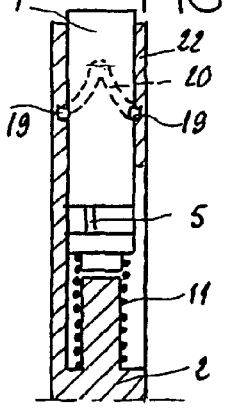
FIG. 8 is a sectional view of this device along the line VIII—VIII of FIG. 7.
Figure 9:
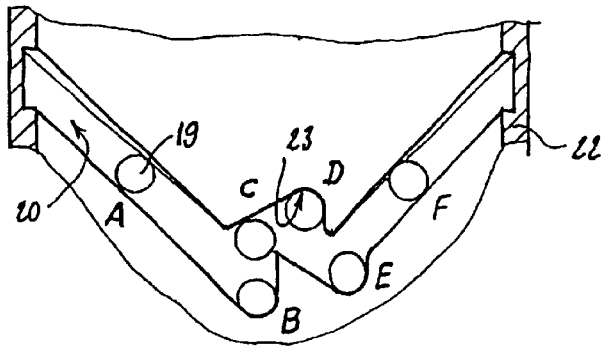
FIG. 9 is a detailed view on an enlarged scale illustrating the means for holding the device in the closed position of the contact.
Figure 10:
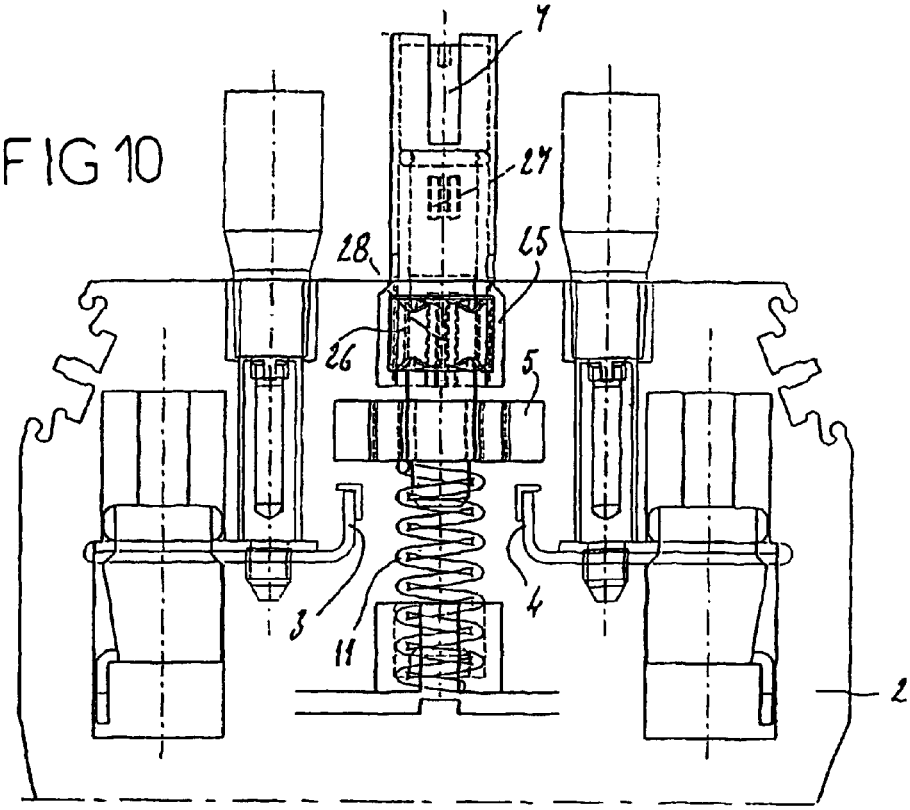
FIGS. 10 and 11 are two front views of another terminal block with an isolatable contact, respectively in the open position and in the closed position of the contact.
Figure 11:
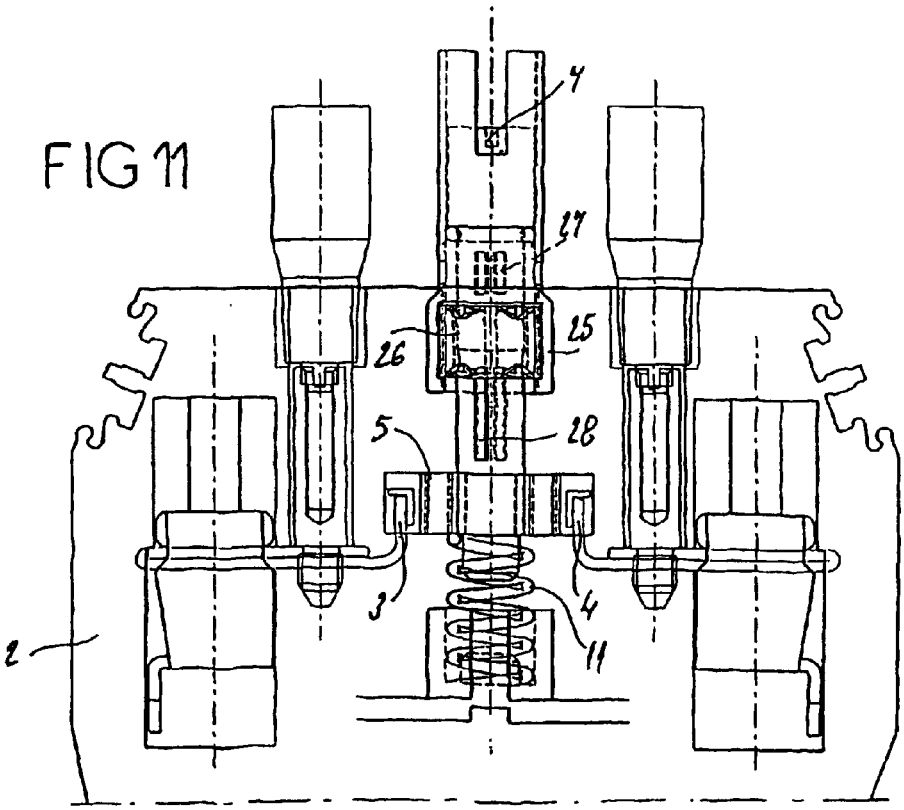
Figure 12:
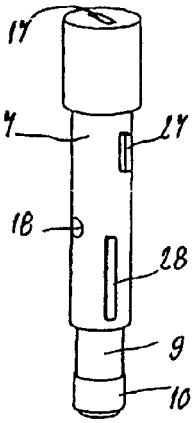
FIGS. 12 and 13 are two views of the device for actuating this electrical contact, in the exploded position and in the assembled position, respectively.
Figure 13:
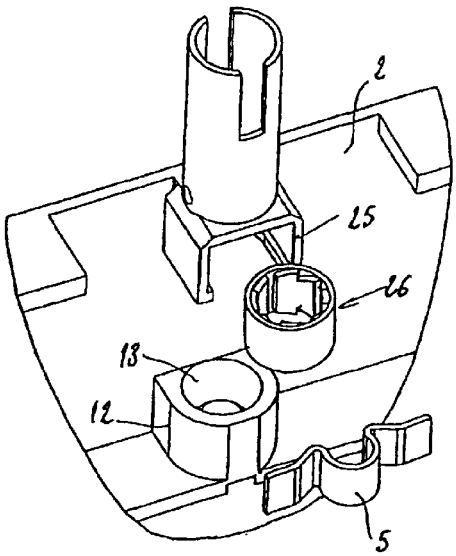
Figure 13:
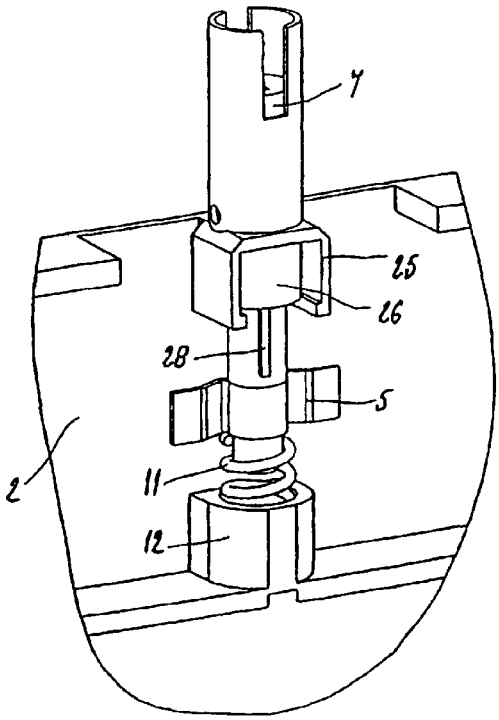

In this embodiment, the rod 7 comprises two diametrically opposed fingers 19 intended to cooperate with an inclined groove 20 extending over 360° inside an annular element 22 for guiding the rod. The groove 20 comprises four paired symmetrical portions. In each low part of the groove 20 there is an upwardly-turned recess 23 in which a finger can be locked, in the low position of the rod, corresponding to a closed position of the contact. This closed position of the contact is shown in FIGS. 7 to 9. As shown in FIG. 9, when a finger descends inside a groove, by translational movement of the rod 7 accompanied by rotational movement thereof, this finger, which occupies position a, comes to a low stop in position b. When the operator releases the pressure exerted on the rod, the spring 11 extends, and the finger comes into position c to bear against a ramp which takes it to position d, that is to say into the bottom of the recess 23. To pass to the open position, the operator exerts pressure on the rod 7 such that the finger 19 in question bears on a ramp located immediately therebelow which brings it to position e from which all the operator has to do is to release the pressure exerted on the rod 7 so that the finger 19 passing into position f returns to the high open position of the contact.

FIGS. 10 to 18 show another embodiment in which the rod 7 simply undergoes a sliding movement between the open position and the closed position of the contact. In this case, the casing forming the terminal block comprises a cage 25 inside which is mounted an internally notched ring 26. This ring 26 is mounted so that it is free to rotate on the rod 7 which has two upper and lower lugs 27 and 28, respectively, axially offset by a distance at least equal to the width of the ring 26, and angularly offset. As shown especially in FIGS. 14 to 18, the inner wall of the ring 26 has lower and upper edges in the form of sawteeth 29. Each tooth 29 is defined by an inclined surface 30 continued by a portion 32 parallel to the axis of the ring. All the inclined portions are inclined in the same direction and the ring has axial grooves 33 extending over its entire height and alternating with the hollow regions 34 between two teeth. The width of each groove 33 is at least equal to the width of the lugs 27, 28. The two lugs 27, 28 are offset circumferentially by a value substantially equal to the length of one tooth. The device operates as follows. FIG. 14 shows the position in which the rod 7 is in the high position. The lug 28 is engaged in a groove 33. When the operator exerts pressure on the rod 7, the lug 27 presses against the inclined surface 30 of the tooth opposite it, which makes the ring 26 pivot until the lug 27 enters the groove 33, as shown in FIG. 15. When the operator releases the pressure exerted on the rod, the lug 28 comes into contact with the lower surface 30 of one tooth of the ring, which makes the ring pivot until the lug 28 is in the bottom 34 of a notch made between two teeth, as shown in FIG. 16. The rod is then kept locked in the closed position of the contact. To open the contact, the rod 7 should be pressed again so that the upper lug 27 bears against the tooth located immediately opposite it, making the ring 26 pivot by a value such that, as shown in FIG. 7, when the pressure exerted on the rod 7 is released, the lug 28 bearing on the surface opposite it makes the ring pivot until it can enter a groove 33, as shown in FIG. 18 which shows a new open position of the contact.

Figure 19:
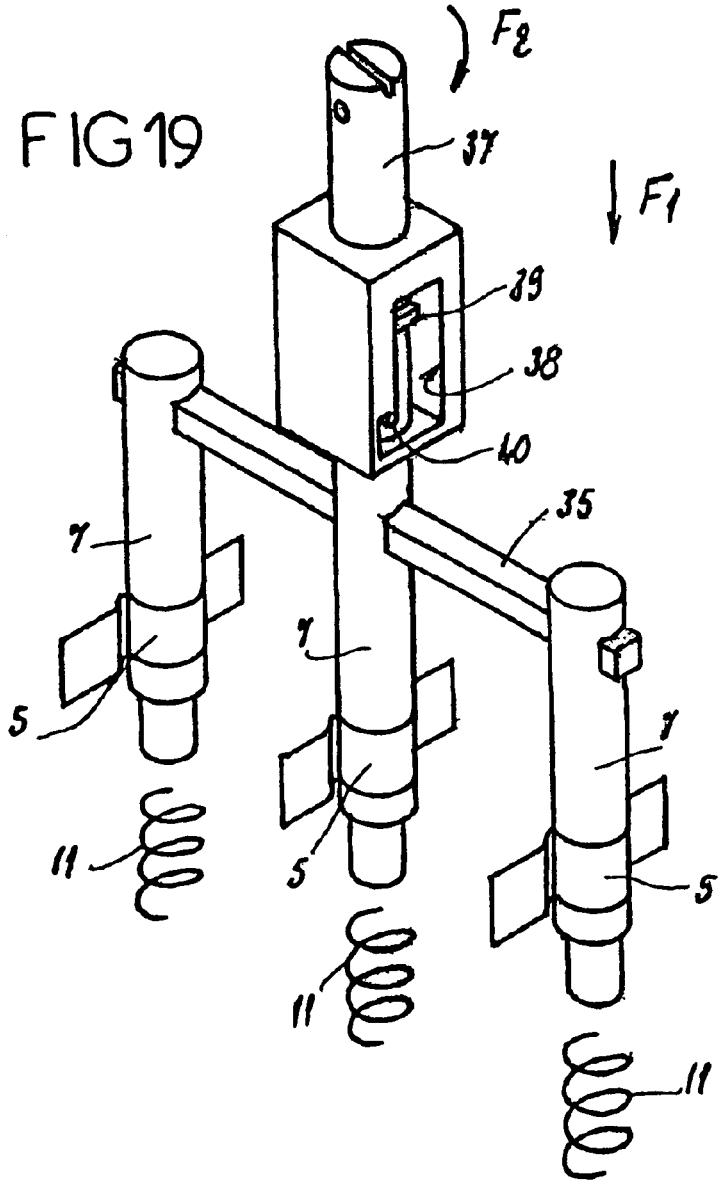
FIG. 19 is a perspective view illustrating a device simultaneously actuating three contacts.

FIG. 19 shows another embodiment of this device in which three rods 7 bearing three blades 5 are intended to be actuated simultaneously. For this purpose, the three rods which, in the embodiment, do not have special locking means are connected by a bar 35. In the example illustrated, the rod 7 of the central blade 7 is provided with a pivoting head 37 translationally linked to the rod 7. The head 37 can be translationally moved within an insulating casing or cage 38 and has a finger 39 designed to engage in a locking groove 40 of the casing 38. Thus, by means of pressure, in the direction of the arrow F1 on the head 37, it is possible to lower the three blades 5 simultaneously, and to rotate the head 37 by a quarter turn in the direction of the arrow F2 making it possible to engage the finger 39 in the groove 40 in order to lock, in the low position, the central rod 7 and the two rods 7 which are linked to it by the bar 35. The blades 5 are thus held in the closed position of the circuits which are associated with them. The head 37 is then in the inserted position. Rotating the head 37 in the reverse direction makes it possible to unlock the system by placing the finger 39 outside the groove 40 such that the springs 11 return the blades 5 into the open position of the circuits and the head 37 into the withdrawn position.

As goes without saying, the invention is not limited just to the embodiments of this device described above by way of example, on the contrary, it encompasses all the variants thereof. Hence, especially in the embodiment shown in FIG. 19, each rod 7 could be identical to the rods described with reference to FIGS. 1 to 4, in order to be able to use standard terminal blocks which may be used either independently or coupled in order to simultaneously control several contacts. Furthermore, where the contact is closed by translation of the rod followed by rotation, it is possible to protect the system against inadvertent closure of the contact by dimensioning the rod such that its end must be inserted into the casing before establishing the contact. Thus, unintentional pressing on the rod bringing it to the casing will not establish contact. In all the embodiments of this device, the contact region can be protected from atmospheric contamination by a lid and/or ribs forming baffles.

What is claimed is:

1. An electrical terminal block comprising, inside an insulating casing:

two conducting components (3, 4) separated from each other, each of which can be connected to a conducting element;

a blade (5) in a form of a conducting strip which can be moved between a closed position of an electrical contact of a circuit in which the blade (5) is in contact with the two conducting components and an open position of the circuit, in which the blade (5) is separated from the components;

a rod (7) translationally connected to the blade (5) and which can be moved axially in the casing (2) between an "inserted" position in the casing in which the blade (5) is in the closed position of the circuit and a "withdrawn" position in which the blade (5) is in the open position of the circuit; and, means for holding the rod (7) in a stable manner in one of the two withdrawn or inserted positions, the means holding the rod (7) in the withdrawn position includes a spiral spring (11) inserted between the casing and the rod (7), and the means holding the rod (7) in the inserted position includes the rod (7) itself.

2. The terminal block as claimed in claim 1, characterized in that the rod (7) comprises coupling means intended to provide a connection between the rod (7) and an adjacent rod for a simultaneous maneuvering of two blades.

3. The device as claimed in claim 2, characterized in that the means holding the rod (7) in the inserted position comprises a finger (8) extending perpendicularly from the rod (7) and engaged in a groove (14) made in the casing (6) for guiding the rod (7), oriented parallel to the rod (7) and comprising, at an end of the groove (14) located closest to the contact, a 90° return (15).

4. The device as claimed in claim 2, characterized in that the means holding the rod (7) fin the recessed position comprises a finger (19) extending perpendicularly from the rod (7) and engaged in an inclined groove (20) made in the casing (22) for guiding the rod (7) and having a notch (23) for locking the finger in the position in which the rod (This most engaged in the casing.

5. The device as claimed in claim 2, characterized in that the means holding the rod (7) in the closed position of the contact comprises a ring (26) which, is around the rod (7) and mounted so that the ring (26) is free in rotation and blocked in translation in the insulating casing, has two sawtoothed edges (29) forming teeth, each tooth of the teeth being defined by an inclined portion (30) followed by a portion (32) parallel to the axis of the ring, all the inclined portions (30) being inclined in the same direction, the ring (26) having axial grooves (33) opening out in an inner wall of the ring (26), made alternately with recessed regions (34) of a profile of the sawtoothed (29), while the rod (7) has two radially protruding lugs (27, 28) which are offset axially by a value at least equal to a width of the ring (26), in order to be located on either side thereof, the two lugs (27, 28) being offset circumferentially by a value substantially equal to a length of one tooth, a lug (27) of the two lugs (27, 28) located on a side of a free end of the rod (7) serving, by pressing against the inclined portions (30) of the teeth of the ring, to cause the ring to rotate, in order successively to bring another lug (28) of the two lugs (27, 28) pressing in one of the recessed regions (34) of one tooth, with an axial position of the rod (7) corresponding to the closure of the contact, and on an inside of one of the axial grooves (33), with an axial position of the rod (7) corresponding to the opening of the contact.

6. The device as claimed in claim 2, characterized in that the blade (5) is mounted so that the blade (5) can rotate freely on the rod (7) that corresponds to the blade (5) and which is guided in translation, with rotational locking, in the insulating casing.

7. The device as claimed in claim 1, characterized in that the means holding the rod (7) in the inserted position comprises a finger (8) extending perpendicularly from the rod (7) and engaged in a groove (14) made in the casing (6) for guiding the rod (7), oriented parallel to the rod (7) and comprising, at an end of the groove (14) located closest to the contact, a 90° return (15).

8. The device as claimed in claim 7, characterized in that the return (15) comprises, at an end of the return (15), a notch (16) for locking the finger.

9. The device as claimed in claim 8, characterized in that the blade (5) is mounted so that the blade (5) can rotate freely on the rod (7) which corresponds to the blade (5) and which is guided in translation, with rotational locking, in the insulating casing.

10. The device as claimed in claim 7, characterized in that the blade (5) is mounted so that the blade (5) can rotate freely on the rod (7) which corresponds to the blade (5) and which is guided in translation, with rotational locking, in the insulating casing.

11. The device as claimed in claim 1, characterized in that the means holding the rod (7) in the recessed position comprises a finger (19) extending perpendicularly from the rod (7) and engaged in an inclined groove (20) made in the casing (22) for guiding the rod (7) and having a notch (23) for locking the finger in the position in which the rod is most engaged in the casing.

12. The device as claimed in claim 11, characterized in that the groove (20) is continuous and the casing in which the groove (20) is made comprises, on a periphery, several successive groove portions successively corresponding to the movement of the rod (7) toward the closed position of the contact and toward the open position of the contact.

13. The device as claimed in claim 12, characterized in that the blade (5) is mounted so that the blade (5) can rotate freely on the rod (7) which corresponds to the blade (5) and which is guided in translation, with rotational locking, in the insulating casing.

14. The device as claimed in claim 11, characterized in that the blade (5) is mounted so that the blade (5) can rotate freely on the rod (7) which corresponds to the blade (5) and which is guided in translation, with rotational locking, in the insulating casing.

15. The device as claimed in claim 1, characterized in that the means holding the rod (7) in the closed position of the contact comprises a ring (26) which, is around the rod (7) and mounted so that the ring (26) is free in rotation and blocked in translation in the insulating casing, has two sawtoothed edges (29) forming teeth, each tooth of the teeth being defined by an inclined portion (30) followed by a portion (32) parallel to the axis of the ring, all the inclined portions (30) being inclined in the same direction, the ring (26) having axial grooves (33) opening out in an inner wall of the ring (26), made alternately with recessed regions (34) of a profile of the sawtoothed edges (29), while the rod (7) has two radially protruding lugs (27, 28) which are offset axially by a value at least equal to a width of the ring (26), in order to be located on either side thereof, the two lugs (27, 28) being offset circumferentially by a value substantially equal to a length of one tooth, a lug (27) of the two lugs (27, 28) located on a side of a free end of the rod (7) serving, by pressing against the inclined portions (30) of the teeth of the ring, to cause the ring to rotate, in order successively to bring another lug (28) of the two lugs (27, 28) pressing in one of the recessed regions (34) of one tooth, with an axial position of the rod (7) corresponding to the closure of the contact, and on an inside of one of the axial grooves (33), with an axial position of the rod (7) corresponding to the opening of the contact.

16. The device as claimed in claim 15, characterized in that the blade (5) is mounted so that the blade (5) can rotate freely on the rod (7) which corresponds to the blade (5) and which is guided in translation, with rotational locking, in the insulating casing.

17. The device as claimed in claim 1, characterized in that the blade (5) is mounted so that the blade (5) can rotate freely on the rod (7) which it corresponds to the blade (5) and which is guided in translation, with rotational locking, in the insulating casing.

* * * * *